US008636181B2

(12) United States Patent
Gunter et al.

(10) Patent No.: US 8,636,181 B2
(45) Date of Patent: Jan. 28, 2014

(54) CHILD CARRIER

(75) Inventors: Mark Gunter, York, SC (US); Jeanna Rimmer, Gastonia, NC (US); Delsie Herrera, Charlotte, NC (US); William Flood, Fort Mill, SC (US)

(73) Assignee: Britax Child Safety, Inc., Charlotte, NC (US)

( * ) Notice: Subject to any disclaimer, the term of this patent is extended or adjusted under 35 U.S.C. 154(b) by 136 days.

(21) Appl. No.: 13/035,616

(22) Filed: Feb. 25, 2011

(65) Prior Publication Data

US 2012/0217273 A1 Aug. 30, 2012

(51) Int. Cl.
*A47D 13/02* (2006.01)

(52) U.S. Cl.
USPC ..... 224/160; 224/158; 224/159

(58) Field of Classification Search
USPC ..... 224/158–160, 161, 600, 606, 625–627, 224/637–641, 674, 675; D3/213, 214
See application file for complete search history.

(56) References Cited

U.S. PATENT DOCUMENTS

| | | | | |
|---|---|---|---|---|
| 3,097,773 | A * | 7/1963 | Cunningham | 224/161 |
| 3,481,517 | A * | 12/1969 | Aukerman | 224/160 |
| 4,009,808 | A * | 3/1977 | Sharp | 224/160 |
| 4,579,264 | A * | 4/1986 | Napolitano | 224/160 |
| 5,522,528 | A * | 6/1996 | Petricola | 224/160 |
| 5,570,823 | A * | 11/1996 | Lindy | 224/160 |
| 5,732,861 | A | 3/1998 | Jakobson | |
| D455,546 | S | 4/2002 | Norman | |
| 6,415,969 | B1 | 7/2002 | Higuchi | |
| 6,715,651 | B2 * | 4/2004 | Le Gal | 224/160 |
| 6,736,299 | B2 | 5/2004 | Bergkvist | |
| D507,102 | S | 7/2005 | Bergkvist et al. | |
| 7,007,353 | B2 | 3/2006 | Bergkvist | |
| 7,070,076 | B2 | 7/2006 | Bergkvist | |
| 7,284,503 | B2 | 10/2007 | Elmberg | |
| 7,322,498 | B2 | 1/2008 | Frost | |
| 7,343,880 | B2 | 3/2008 | Bergkvist | |

(Continued)

FOREIGN PATENT DOCUMENTS

| | | |
|---|---|---|
| JP | 2003 010010 A | 1/2003 |
| JP | 2005 185426 A | 7/2005 |

(Continued)

OTHER PUBLICATIONS

Partial European Search Report for Application No. EP 11 00 8844 dated Sep. 19, 2012.

*Primary Examiner* — Adam Waggenspack
(74) *Attorney, Agent, or Firm* — Alston & Bird LLP

(57) ABSTRACT

A child carrier that may be worn by an adult and support a child in either a forward-facing or rearward-facing position is provided. The child carrier may include a pouch assembly including a bottom portion and a front portion, where the weight of the child in a first position is configured to be substantially supported by the bottom portion. The child carrier may further include a removable insert configured to be removably installed into the child carrier, where when the removable insert is installed in the child carrier, the weight of the child in a second position is configured to be substantially supported by the removable insert. The child carrier may further include a harness assembly attached to the pouch assembly, where the removable insert may be configured to be attached at one end to the pouch assembly and at another end to the harness assembly.

20 Claims, 9 Drawing Sheets

(56) References Cited

U.S. PATENT DOCUMENTS

| | | | | |
|---|---|---|---|---|
| 7,766,199 | B1 | 8/2010 | Caperon | |
| 7,770,765 | B2 | 8/2010 | Stevens et al. | |
| 2002/0130148 | A1 | 9/2002 | Le Gal | |
| 2004/0206793 | A2 * | 10/2004 | Enes | 224/260 |
| 2005/0184114 | A1 * | 8/2005 | Hoff et al. | 224/160 |
| 2007/0241147 | A1 | 10/2007 | Nyberg et al. | |
| 2007/0278264 | A1 * | 12/2007 | Chesal et al. | 224/160 |
| 2011/0042429 | A1 | 2/2011 | Frost | |
| 2012/0043359 | A1 | 2/2012 | Bergkvist et al. | |

FOREIGN PATENT DOCUMENTS

| | | | |
|---|---|---|---|
| JP | 2008 206929 | A | 9/2008 |
| WO | WO 2010/123434 | A1 | 10/2010 |
| WO | WO 2010/123445 | A1 | 10/2010 |
| WO | WO-2010/123447 | A1 | 10/2010 |

* cited by examiner

CHILD CARRIER

TECHNOLOGICAL FIELD

The present invention relates to infant and toddler carriers, often called baby carriers or child carriers, configured to support an infant or toddler in a harness or sling that is worn by an adult, and, more particularly, to infant or toddler carriers that are configured to be worn by an adult and support a child in front of the adult in either a forward-facing or rearward-facing position.

BACKGROUND

Child carriers are designed to be worn by an adult and carry a child therein. Child carriers may support a child in a forward-facing or rearward-facing position, and child carriers may be configured to position the child on the front and/or back of the adult wearing the child carrier.

Two main functions of a child carrier are to position a child within the carrier comfortably and safely and to secure the carrier to the wearer comfortably and safely. Factors influencing the comfort of a child include proper support, such as a weight-supporting seat or cradle, and proper positioning of the child's torso, head, neck, and legs. Securely holding a child in the proper position ensures both comfort and safety of the child. It may be desirable to provide multiple positions and multiple support configurations of a child carrier such that a child can be comfortably secured within the child carrier as the child grows without requiring an entirely different child carrier.

Factors influencing the comfort of a wearer include harness shape, proper harness position, and weight distribution among others. The harness shape may be uncomfortable for a wearer if it is not properly sized and the harness may be uncomfortable if it is in the incorrect position. Further, it may be uncomfortable to carry the majority of the weight of a heavier child within the child carrier on the shoulders of the wearer as this may create an imbalance as the wearer moves about. Therefore it may be desirable to have a harness shape that accommodates wearers of different sizes and a harness that remains in the proper position when worn by a wearer. Further, distributing the weight of an occupant of the child carrier between the shoulders and the waist or hips of a wearer may increase the weight capacity for which the child carrier can be comfortably worn.

BRIEF SUMMARY

Various embodiments of the present invention are directed to child carriers that may be worn by an adult and support a child in either a forward-facing or rearward-facing position.

A child carrier according to example embodiments of the present invention may include a pouch assembly including a bottom portion and a front portion, where the weight of the child in a first position is configured to be substantially supported by the bottom portion. The child carrier may further include a removable insert configured to be removably installed into the child carrier, where when the removable insert is installed in the child carrier, the weight of the child in a second, elevated position is configured to be substantially supported by the removable insert. The child carrier may further include a harness assembly attached to the pouch assembly, where the removable insert may be configured to be attached at one end to the pouch assembly and at another end to the harness assembly. The harness assembly may include a waist belt where shoulder straps extend from a first point on the waist belt and where the pouch assembly is attached to the waist belt near the first point. The shoulder straps may extend from the first point on the waist belt to a shoulder web. The child carrier may further include two mid-harness straps extending from the shoulder web and each at least indirectly and adjustably engaging a respective mid-pouch strap of the pouch assembly. The removable insert may be configured to be attached to the pouch assembly by a zipper. At least one attachment point of the removable insert to the pouch assembly may be isolated from the child in the child carrier by a flap. The child carrier may further include a second removable insert, where when the second removable insert is installed in the child carrier, the weight of the child in a third, rearward-facing position is configured to be distributed over a greater surface area provided by the second removable insert. The second removable insert may be configured to position the child's legs in a splayed position at least partially around the waist of a wearer.

Another example embodiment of a child carrier according to the present invention may include a pouch assembly including a bottom portion, a front portion, mid-pouch straps extending from the front portion, and upper-pouch straps extending from the front portion; and a harness assembly, where the pouch assembly is substantially permanently attached to the harness assembly proximate the bottom portion, where the pouch assembly is releasably attached to the harness assembly by the upper-pouch straps, and where the pouch assembly is adjustably attached to the harness assembly by the mid-pouch straps. The pouch assembly may be further configured to be attached to the harness assembly by a removable insert. The removable insert may be configured to provide an elevated seating area relative to the bottom portion when the removable insert is attached between the harness assembly and the pouch assembly. The attachment means for the upper-pouch straps to the harness assembly may be reversible.

Another example embodiment of the present invention may provide a child carrier that includes a harness assembly including a first and second shoulder strap extending from a waist belt, where the first and second shoulder straps are configured to extend over a right and left shoulder respectively; a pouch assembly comprising a front portion and a bottom portion, wherein a pouch is defined on a first side by a front portion, on a second side by the first and second shoulder straps, and on a bottom by the bottom portion; and a removable insert configured to be releasably attached to the pouch on a first side to the front portion and on a second side to the first and second shoulder straps, where the removable insert is elevated relative to the bottom of the pouch when attached to the pouch and the shoulder straps. The removable insert may be releasably attached to the front portion by a zipper attachment and where the removable insert is releasably attached to the first and second shoulder straps by a zipper. The child carrier may further include a first flap attached to the front portion and configured to cover the zipper attachment of the front portion and a second flap configured to cover the zipper attachment of the first and second shoulder straps. The child carrier may further include a shoulder web, where the first and second shoulder straps extend from the waist belt, over the left and right shoulders of the wearer respectively, and terminate at the shoulder web.

A further example embodiment of the present invention may provide for a child carrier including a harness assembly including a shoulder web, where first and second shoulder straps extend from a top portion of the shoulder web and first and second mid-harness straps extend from a bottom portion of the shoulder web. The child carrier may further include a pouch assembly including first and second upper-pouch straps and first and second mid-pouch straps, where the first and second upper-pouch straps are configured to attach to the first and second shoulder straps, respectively, and where the first and second mid-pouch straps are configured to attach to the first and second mid-harness straps, respectively. The child carrier may further include a waist belt, where the first and second shoulder straps attach to the waist belt at a first location and where a bottom portion of the pouch assembly is attached to the waist belt proximate the first location. The first and second shoulder straps, together with the shoulder web, may form a U-shape. The first and second mid-harness straps may extend at an angle between an axis formed across the shoulders of a wearer and an axis along the height of a wearer.

BRIEF DESCRIPTION OF SEVERAL VIEWS OF THE DRAWING(S)

Reference will now be made to the accompanying drawings, which are not necessarily drawn to scale, and wherein.

DETAILED DESCRIPTION

The present invention will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in the example embodiments illustrated in the figures. The drawings omit illustration of certain energy absorbing materials, padding, fabric, and other coverings to facilitate ease of visibility and understanding of features of the invention.

Various embodiments of the present invention provide a child carrier configured to be worn by a wearer and carry a child of up to about 40 pounds in front of the wearer. The child may be positioned in either a forward-facing (away from wearer) or rearward-facing (toward wearer) position. Example embodiments may include adjustable features to comfortably accommodate children of varying sizes and weights and adjustable features to ensure the child carrier is comfortable for the wearer.

Figure 1:
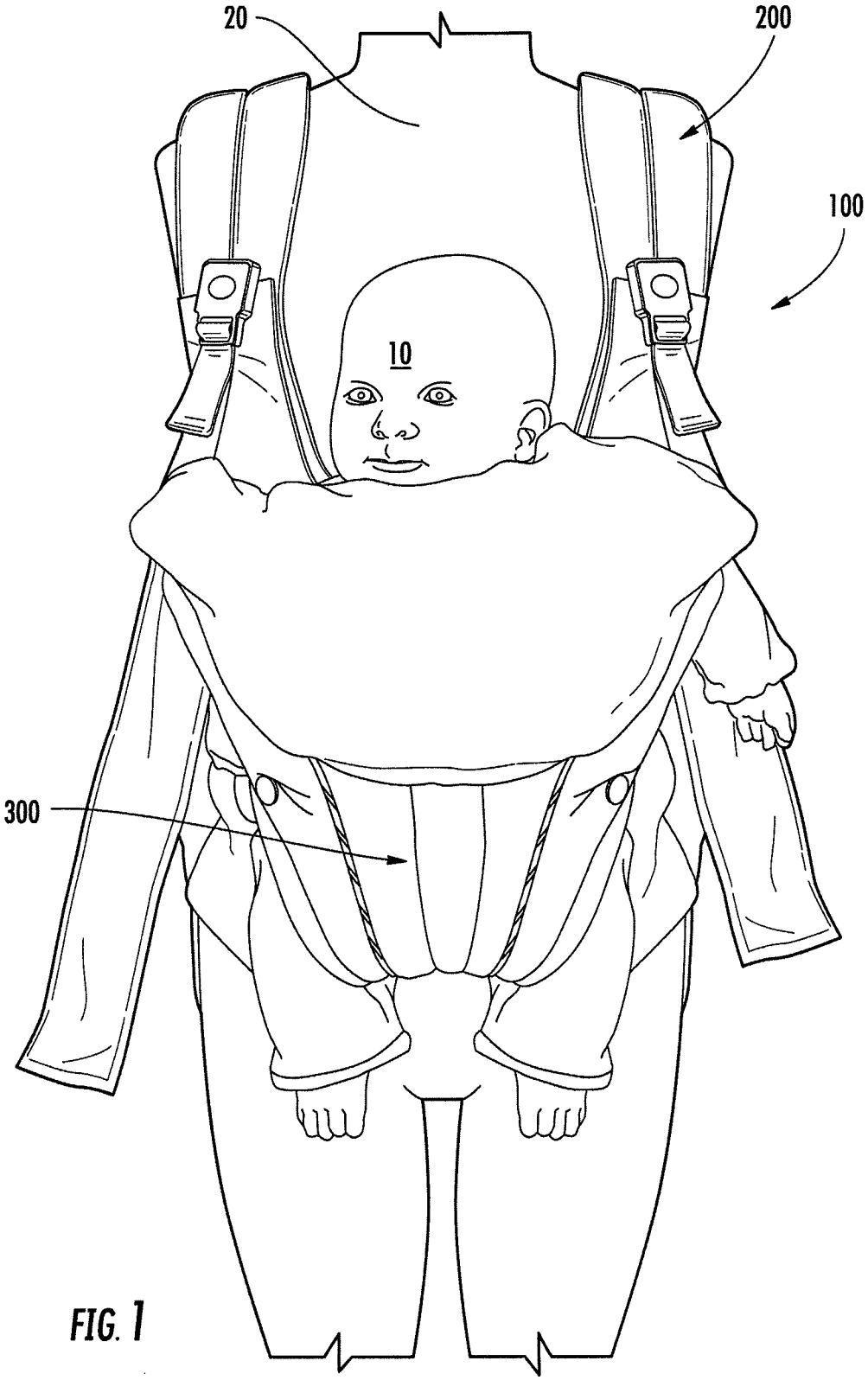
FIG. 1 is a child carrier according to an example embodiment of the present invention as worn by a wearer and carrying a child in a forward-facing position.

FIG. 1 illustrates a child carrier 100 according to an example embodiment of the present invention in which the child 10 is in a forward-facing position. The child carrier 100 may include two primary components: a harness assembly 200 for securing the child carrier 100 to a wearer 20; and a pouch assembly 300 for securely holding a child 10 to the harness assembly 200.

Figure 2:
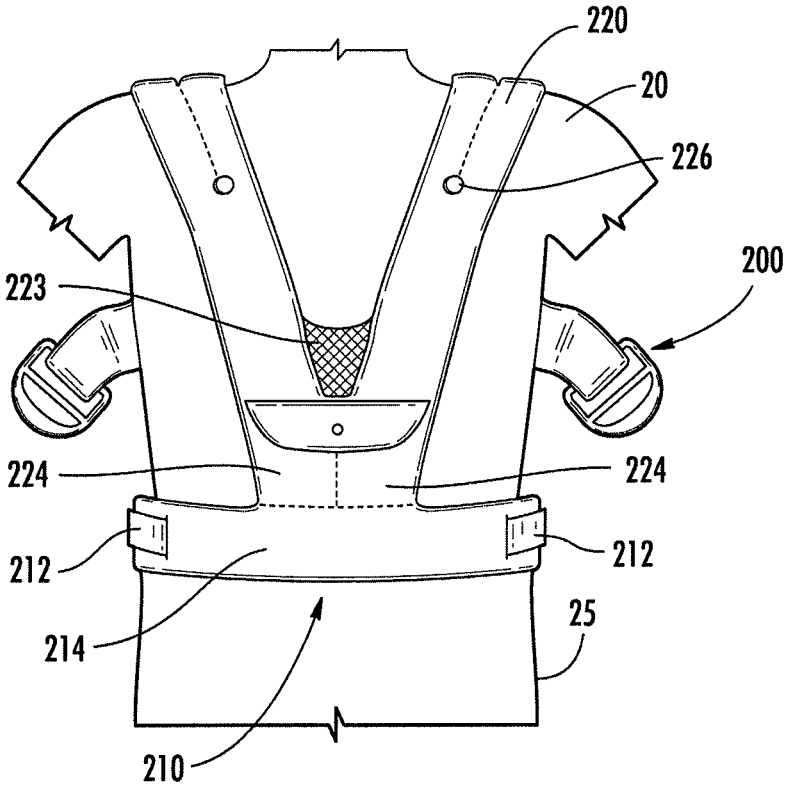
FIG. 2 is the harness assembly of a child carrier according to an example embodiment of the present invention.

FIG. 2 illustrates the harness assembly 200 depicted without the pouch assembly 300 for ease of illustration. However, the absence of the pouch assembly 300 does not necessarily imply that the pouch assembly is or is not removable. The harness assembly 200 includes a waist belt 210 configured to extend around the waist of a wearer 20. The waist belt may include straps 212 extending from a mid-section 214. The straps may be of any flexible material, but in a preferred embodiment are nylon webbing which is flexible, durable, and substantially non-elastic along its major length. The mid-section 214 may be a single thickness of fabric, such as a nylon webbing, but is preferably a padded section with a fabric covering to improve the comfort of the waist belt 210 on a wearer 20. A padded mid-section 214 may also protect a child occupant of the child carrier 100 from potentially sharp or hard surfaces and edges of a belt worn by the wearer 20. The straps 212 of the waist belt 210 may be secured around the wearer by a buckle, such as a side release buckle. The nylon webbing straps 212 may include a length adjustment such that the waist belt 210 may be adjusted to the appropriate size for the wearer 20. The waist belt 210 may be configured to be worn by a user just above the hips 25 of the wearer 20 such that weight applied to the waist belt 212 is carried by the hips 25 of the wearer, reducing the weight carried by the wearer's back as will be described further below.

The harness assembly 200 further includes two shoulder straps 220, each extending from a first end 224 which is attached, at least indirectly, to the waist belt 210. The shoulder straps 220 form a V-shape as they extend away from the waist belt 210, over the shoulders of the wearer 20. A piece of fabric 223, such as an elastic webbing or mesh, may be disposed between the shoulder straps 220 proximate their apex. The piece of fabric 226 may reduce the likelihood of a child inserting a hand or appendage or dropping objects down the apex of the V-shape created by the shoulder straps 220. In a preferable embodiment the piece of fabric 226 is an elastic mesh that is breathable, yet serves the purposes identified above.

The shoulder straps 220 may each be substantially unpadded between the first end 224 and a pouch attachment point 226. The lack of padding proximate the pouch area provides less space between a wearer 20 and a child 10 in the child carrier 100. Further, as the portion of the shoulder straps 220 between the first end 224 and the pouch attachment points 226 does not apply the weight of the child carrier 100 and occupant 10 to the wearer 20, comfort is not sacrificed. The shoulder straps 220 may each be substantially padded along their length from around the pouch attachment point 226, over the shoulder of the wearer 20, to the shoulder web 230, illustrated in FIG. 3. The fabric used for the waist belt 210 and shoulder straps 220 is preferably a washable, stain and water resistant material, such as nylon; however, the fabric may be any fabric that has the necessary flexibility and strength to perform the function of supporting the weight of a child 10 in the child carrier 100.

Figure 3:
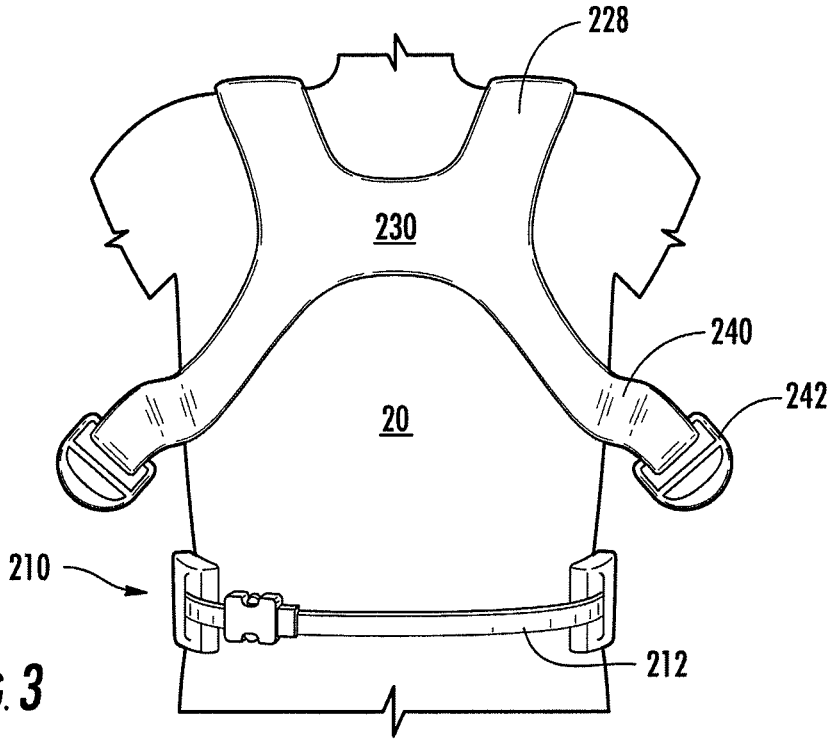
FIG. 3 is another view of the harness assembly of the child carrier of FIG. 2.

As illustrated in FIG. 3, the shoulder web 230 includes a broad span of fabric configured to attach to a second end 228 of the shoulder straps 220. The shoulder web 230 provides a fixed width between the second ends 228 of the shoulder straps 220 of approximately six to ten inches, preferably around eight inches measured from the middle of the second end of a first shoulder strap to the middle of the second end of a second shoulder strap. Providing a fixed width between the shoulder straps 220 at the shoulder web 230 ensures that the shoulder straps 220 sit comfortably proximate a mid-point of the shoulder of the wearer and preclude the shoulder straps 220 from either being too narrow and rubbing or chafing the neck of the wearer or being too wide and sliding off of the edges of the wearer's shoulders. The "U" shape where the shoulder straps 220 meet the shoulder web 230 may allow the shoulder web to be situated high on the wearer's shoulders without the shoulder web impinging on the neck of the wearer. The weight carried by the shoulder straps 220 of the harness assembly 200 is transferred to the wearer through the portions of the shoulder straps 220 that pass over the tops of a wearer's shoulders, but the weight is also transferred to the wearer through the shoulder web 230. The width of the shoulder web 230 provides for a more even distribution of weight across a wearer's shoulders which results in a more comfortable harness assembly 200. The shoulder web 230 may further have sufficient height to provide an increased surface area for distributing the weight of the child carrier across the shoulders of the wearer. As illustrated in FIG. 3, the height in the middle of the shoulder web 230, between the shoulder straps 220, may be around two to five inches, and preferably around three and a half inches, thereby providing a shoulder web 230 surface area of between around 25 and 40 square inches. The increased surface area may distribute the weight of the child carrier (and child) and reduce the pressure on a wearer better than an arrangement without a shoulder web 230. The increased surface area helps distribute the weight of the child carrier across the shoulders of a wearer in a more comfortable position while also maintaining proper position and alignment of the shoulder straps across a wearer's shoulders. While the shoulder web 230 is illustrated as a seamless unit with the shoulder straps 220 and mid-harness straps 240, the shoulder web 230 may be a separate piece to which the shoulder straps 220 and mid-harness straps 240 are attached.

Mid-harness straps 240 extend from the bottom of the shoulder web 230 at an angle of about midway between the horizontal axis across the wearer's shoulders and the vertical axis along the wearer's height. Extending at an angle between the horizontal and vertical axes allows the mid-harness straps to extend comfortably below the wearer's arms and around the wearer's torso. The mid-harness straps 240 may each terminate in a connector 242, such as a straplock connector as will be further detailed below. The angle at which the mid-harness straps 240 descend from the shoulder web 230 may further promote weight distribution from the child carrier to the shoulder web 230 by effectively pulling down and around the torso of the user. Mid-harness straps extending horizontally around the torso of the wearer or at a less advantageous angle may not serve to transmit weight from the child carrier to the shoulder web with the same high level of efficiency.

Figure 4:
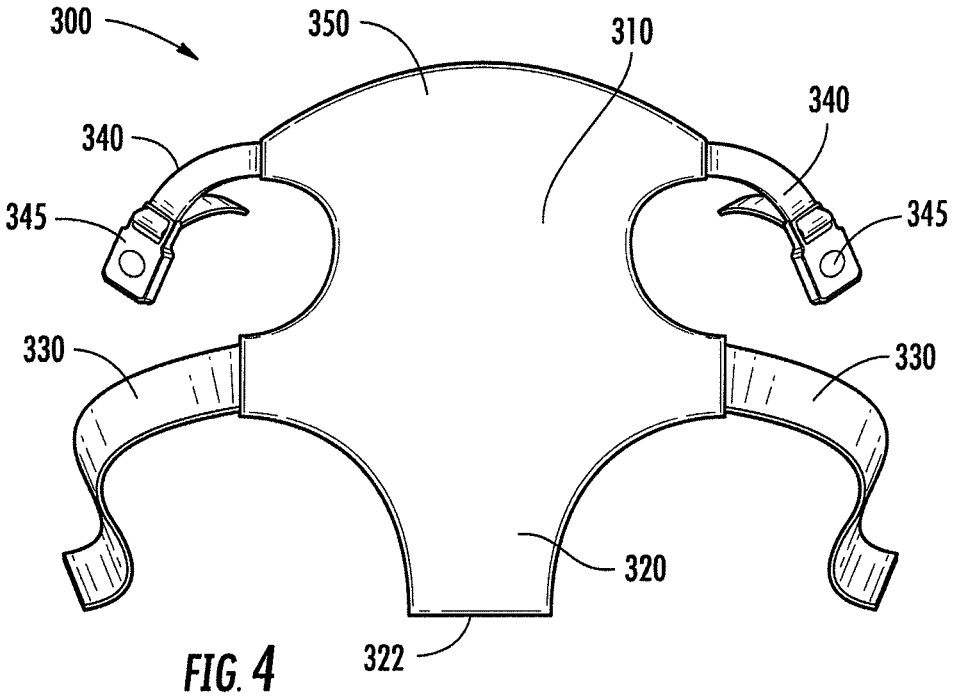
FIG. 4 is the pouch assembly of a child carrier according to an example embodiment of the present invention.

FIG. 4 illustrates the pouch assembly 300 comprising a front portion 310, a bottom portion 320, mid-pouch straps 330, and upper pouch straps 340. The bottom portion 320 may be configured to be attached at its lower end 322 to the waist belt 210 proximate where the shoulder straps 220 are attached to the waist belt 210. The mid-pouch straps 330 are each configured to be received in a respective connector 242 of a mid-harness strap 240. The upper pouch straps 340 each may include a connector 345 which may be configured to attach to a respective pouch attachment point 226 of a shoulder strap 220. The connector may include a rectangular front face and a rectangular rear face spaced apart by a body of about a quarter inch of thickness. The connector may include a through hole between the rectangular front face and rectangular rear face, disposed in which are two spring-loaded arms. The spring loaded arms being configured to grasp the attachment point 226 which may be a button. The connector 345 may be configured to attach to the attachment point by placing the orifice of either of the front face or the rear face over the attachment point until the spring loaded arms engage the attachment point 226. As such, the connector 345 is reversible and may be attached to the attachment point 226 from either side of the connector 345, as will be appreciated further below.

Figure 5:
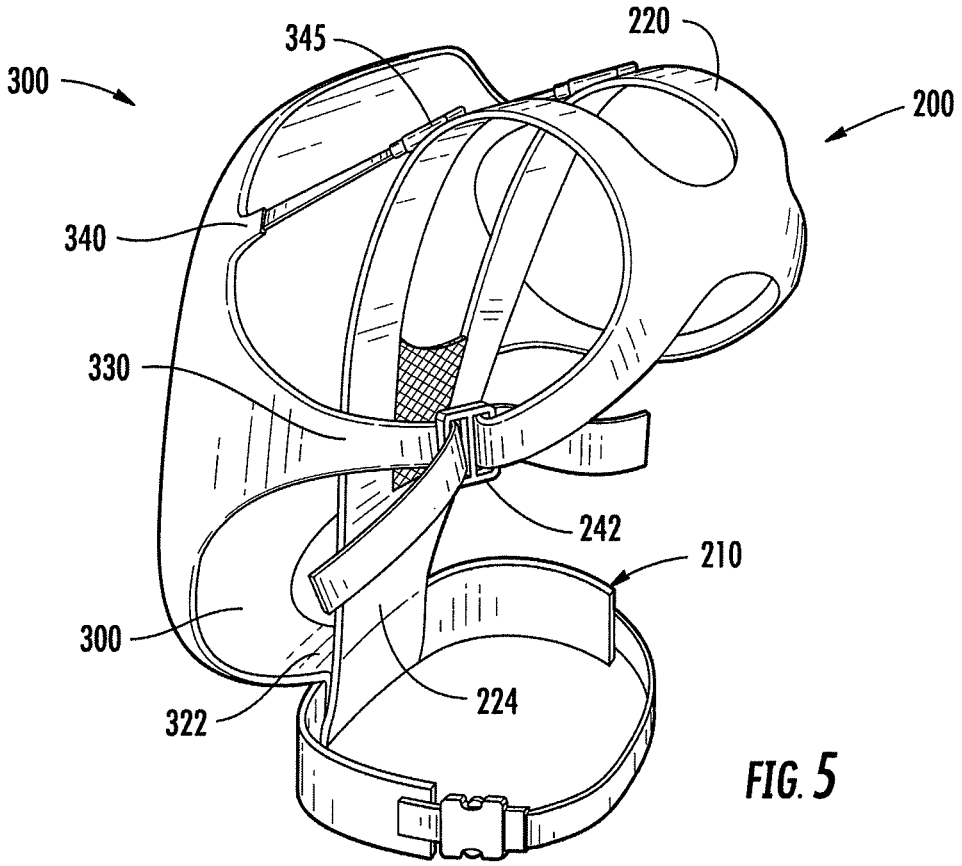
FIG. 5 is another view of the pouch assembly of the child carrier of FIG. 4.

FIG. 5 depicts the pouch assembly 300 as attached to the harness assembly 200. The pouch assembly is attached along a bottom edge 322 of the bottom portion 320 to the waist belt proximate the point where a first end 224 of the shoulder straps 220 are attached to the waist belt 210. The bottom edge 322 of the pouch assembly 300 and the first end 224 of the shoulder straps 220 may be sewn to the waist belt such that they are substantially permanently attached (i.e., not intended for separation by a consumer). Optionally, the bottom edge 322 of the pouch assembly 300 may be removably attached in some embodiments for ease of ingress/egress of an occupant or interchangeability of attachments, such as with a zipper connection. The mid-pouch straps 330 are each adjustably received within the connectors 242 of the harness assembly 200. The upper pouch straps 340 are each releasably attached to a respective pouch attachment point 226 of the shoulder straps 220 with connectors 345.

Figure 6:
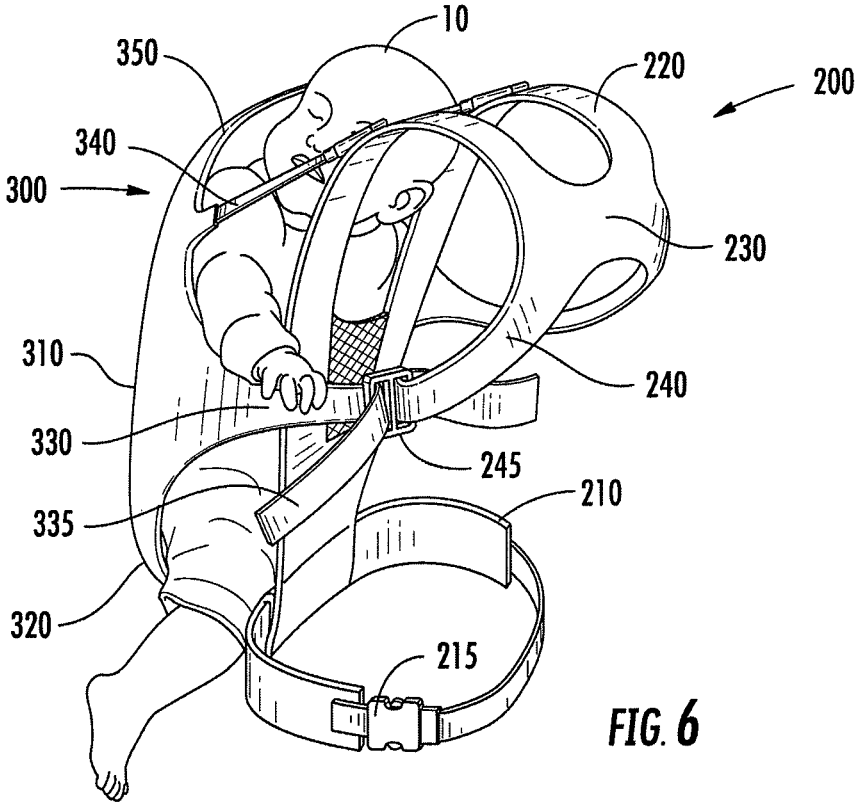
FIG. 6 is an example embodiment of a child carrier according to the present invention carrying a child in a rearward-facing position.

As described above, example embodiments of the present invention may be configured to hold a child 10 in a rearward-facing position (i.e., the face of the child is toward the face of the wearer) as illustrated in FIG. 6. In the rearward facing position illustrated, the child's weight is primarily supported by the bottom portion 320 of the pouch assembly 300. The force exerted on the bottom portion 320 by the child is transferred to the attached waist belt 210 and the shoulder straps 220 such that the wearer carries the weight of the occupant on the hips and shoulders. The child is held upright by the front portion 310 of the pouch assembly 300. The force exerted against the front portion 310 by the occupant is transferred to the shoulder web 230 by the upper pouch straps 340 and the mid-pouch straps 330. In the illustrated position, when the child carrier is properly worn, the weight of the child is primarily carried by the hips of the wearer with the shoulder straps 220 and shoulder web 230 providing supplemental support and balance.

Figure 7:
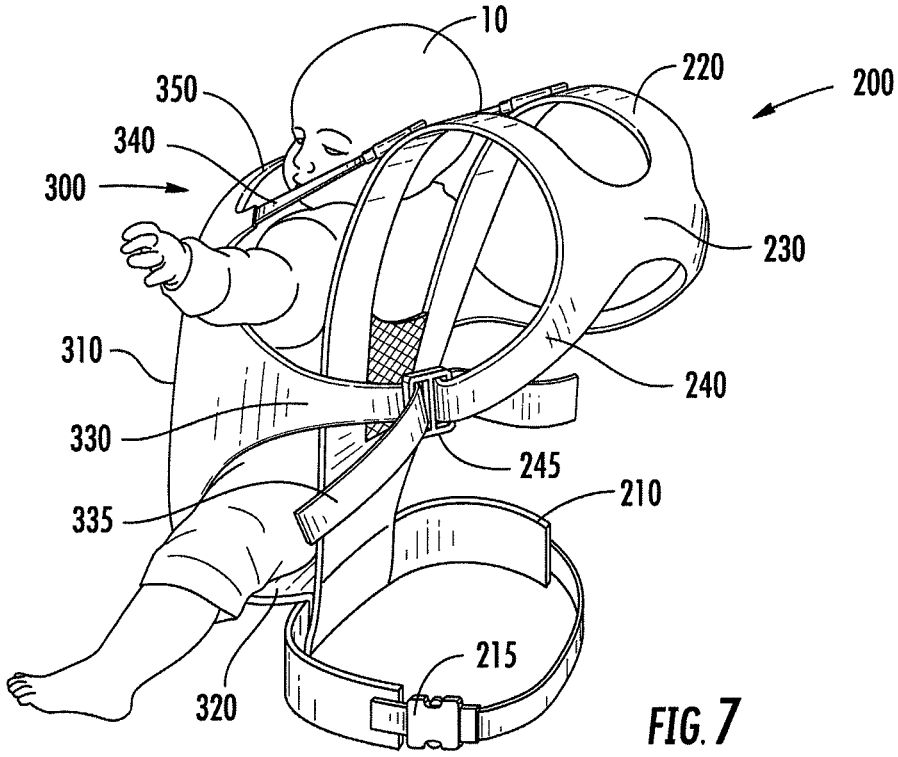
FIG. 7 is an example embodiment of a child carrier according to the present invention carrying a child in a forward-facing position.

FIG. 7 illustrates a child carried in the child carrier in the forward-facing position wherein the child 10 is facing the same direction as the wearer. The child's weight is primarily supported by the bottom portion 320 of the pouch assembly 300. As with the rearward-facing position illustrated in FIG. 6, the force exerted on the bottom portion 320 by the child is transferred to the attached waist belt 210 and the shoulder straps 220 such that the wearer carries the weight of the occupant on the hips and shoulders. The front portion 310 holds the child 10 in an upright position and prevents the child from pivoting forward. The force exerted on the front portion 310 by the child 10 is transferred by the upper pouch straps 340 and the mid-pouch straps 330. In the illustrated position, when the child carrier is properly worn, the weight of the child is primarily carried by the hips of the wearer with the shoulder straps 220 and shoulder web 230 providing supplemental support and balance. However, when a wearer bends forward, as to tie a shoe or pick something up, the weight of the child 10 may be transferred to be primarily supported, or at least a greater proportion may be supported, by the front portion 310 of the pouch assembly 300 applying greater force through the upper pouch straps 340 and mid-pouch straps 330 such that the wearer carries the additional weight through the shoulder web 230.

Figure 8:
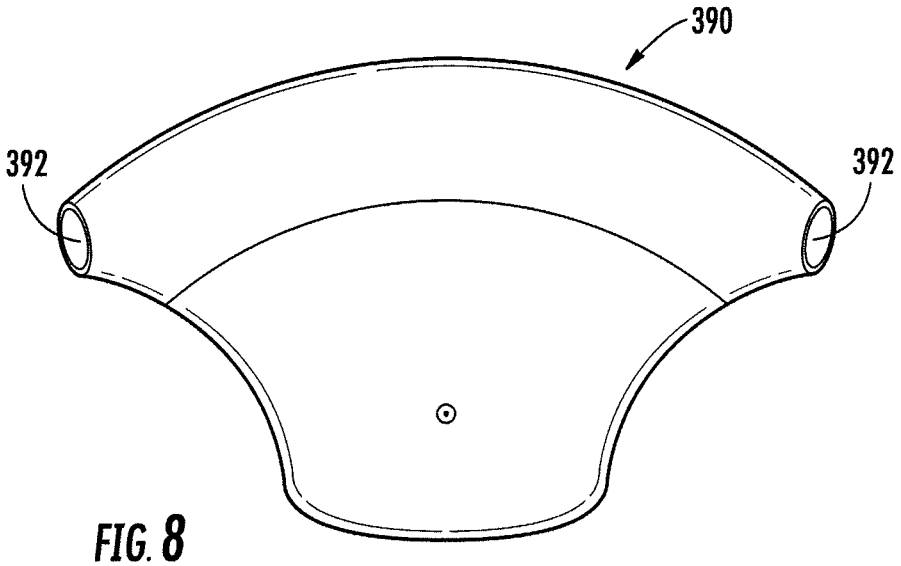
FIG. 8 is an example embodiment of a removable cover for child carriers according to the present invention.

While a child is in the rearward-facing position, the front portion 310 of the pouch assembly may be in a first, unfolded position, as illustrated in FIG. 6, when the child 10 is in a forward-facing position as illustrated in FIG. 7, a top portion 350 of the front portion 310 may be folded down, away from the child's face. The top portion 350 may provide support for a child's head when the child is in a rearward-facing position such that the child's head is held securely and is not in danger of swaying or nodding over the front portion 310 of the pouch. When a child is old enough to support and control their head movements, a child may be placed in the forward-facing position wherein if the top portion 350 of the front portion 310 of the pouch was not folded, it would obstruct the child's view and possibly be uncomfortable for the child. When the top portion 350 of the front portion 310 of the pouch is folded down, the child 10 may have a clear, unobstructed view and the child may be more comfortable. When in a first, unfolded position, the upper-pouch attachment straps 340 may be attached to the shoulder straps 220 with the connector 345 attached to the strap attachment point 226 in a first position. When the top portion 350 of the pouch assembly 300 is in a second, folded position to accommodate a forward facing occupant, the upper-pouch attachment straps 340 may be attached to the shoulder straps 220 with the connector 345 attached to the strap attachment point 226 in a second, reversed position. The top portion 350 of the pouch may also be provided with a removable cover 390 as shown in FIG. 8. The removable cover 390 may include openings 392 through which the upper-pouch straps 340 may pass when the cover 390 is attached to the upper portion 350 of the pouch. The removable cover 390 may be made of any flexible material, but is preferably an absorbent, washable material that provides a comfortable surface for a child's chin on which to rest and possibly to absorb any saliva or food that may exit the mouth of the child.

In the illustrated embodiments of FIGS. 6 and 7, the child carrier may be adjustable to accommodate children of different sizes and the child carrier may be adjustable to accommodate wearers of different sizes. For example, the waist belt 210 may include a connector 215 such as a side release buckle that enables a user to adjust the length of the straps 212 of the waist belt 210 to accommodate waists of different sizes. Additionally, in the case of a very large waist, a belt extender (not shown) may be inserted between the mating ends of the connector 215 to provide additional length. Either of the mid-harness straps 240 or the mid-pouch straps 330 which are engaged by the mid-harness straps 240 may include a length adjusting mechanism such as a straplock connector 245 as shown. The length of either the mid-pouch strap 330 or the mid-harness strap 240 may be adjusted such that the child 10 held in the pouch assembly 300 is held snugly against the wearer. The length adjusting mechanism may provide for strap ends, such as mid-pouch strap ends 335 to extend down and forward of a wearer such that the wearer may easily grasp the mid-pouch strap ends 335 and adjust the length of the mid-pouch straps 330 to the proper fit. The angle at which the mid-harness straps 240 descend from the shoulder web 230 may be configured such that the pulling forces exerted on the mid-pouch strap ends 335, while serving to shorten the effective length of the mid-pouch strap 330, exert an reactive force through the shoulder web 230 substantially to the shoulder opposite the side from which the mid-harness strap 240 is being pulled. Thus, the angular alignment of the mid-harness strap 240 affords a relatively sturdy point against which the pulling force is exerted. Further, the angle at which the mid-harness straps 240 descend from the shoulder web 230 places the mid-pouch strap ends 335 of the mid-pouch straps 330 in a position conducive to pulling with the hand from the side of the body from which the strap 330 extends (i.e., the right hand may comfortably pull the mid-pouch strap end 335 extending from the right side of the wearer and vice versa). The angle at which the mid-pouch strap ends 335 may be pulled to shorten the effective length of the mid-pouch straps 330 may also be in a line of motion in which the wearer has significant mechanical advantage (i.e., the arm of the wearer is well positioned to exert a strong force). Shortening the mid-pouch straps 330 may also serve to elevate the child 10 relative to the wearer as shortening the mid-pouch straps 330 may also draw the shoulder web 230 lower down the back of a wearer, effectively raising the bottom 320 of the pouch assembly 300 relative to the wearer.

While the embodiments illustrated in FIGS. 6 and 7 may be adjustable to accommodate children of varying sizes, up to about forty pounds, the above noted degree of adjustability may not be sufficient or ideal for very small children or infants, such as those under about ten pounds. The openings through which a child's legs pass may be too large for an infant and the use of a child carrier configured for larger children may be potentially unsuitable for infants if the child carrier is not properly configured for infants.

Figure 9:
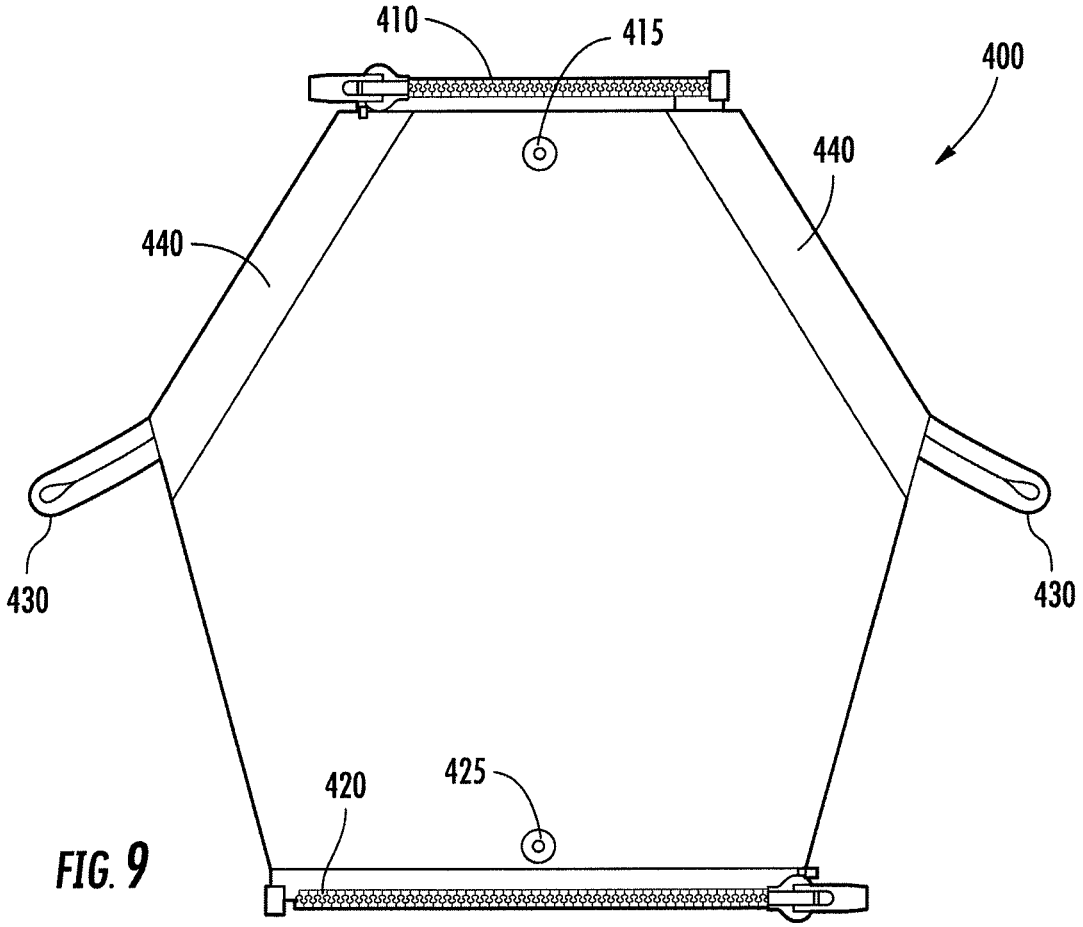
FIG. 9 is an illustration of a first insert according to an example embodiment of the present invention.

Embodiments of the present invention may include an insert arranged to improve the function of the child carrier 100 for small children and infants. FIG. 9 illustrates an example embodiment of a first insert 400 configured for use with embodiments of the present invention. The first insert 400 includes a first zipper 410 at a first side of the insert and second zipper 420 at a second, opposite side of the inert. As is known, a zipper includes two interlocking sets of zipper teeth and a zipper pull. The first zipper 410 and the second zipper 420 each include one of the interlocking sets of zipper teeth and the zipper pull, each configured to engage a second, mating set of zipper teeth attached to the child carrier 100. While the illustrated embodiment includes a zipper attachment means, the attachment means may also be buttons, snaps, or the like. The first insert 400 may further include fastener loops 430 and flap attachment means 415 and 425 which may include snaps, buttons, magnetic snaps, or other quick release fastening mechanisms. The first insert 400 may further include padded edges 440 proximate where a child's legs would rest when seated on the first insert 400 disposed within the child carrier 100. The padded edges 440 may increase the comfort of the child by reducing or limiting the pressure on the child's legs at the point of exit from the child carrier 100.

Figure 10:
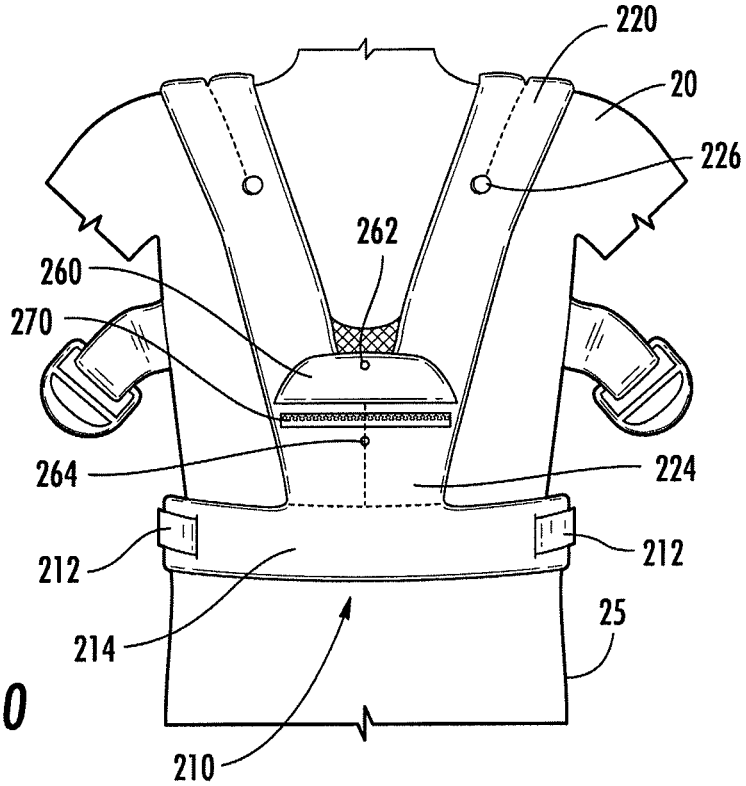
FIG. 10 is another illustration of a harness assembly according to an example embodiment of the present invention.

FIG. 10 illustrates the harness assembly 200 of FIG. 2 adapted for use with the first insert 400 of FIG. 9. The harness assembly 200 may include a set of zipper teeth 270 configured to mate with the first zipper 410 of the first insert 400. The harness assembly 200 may further include a flap 260 arranged to overlay the zipper teeth 270 such that a child occupant of the child carrier is not in direct contact with the zipper 270 as they may provide discomfort or a surface on which the child's clothing may rub. The flap may include a snap 262 configured to engage the snap 415 of the first insert when the first insert 400 is attached to the harness assembly 200 by the mating zipper teeth 410, 270. When the first insert 400 is not attached to the harness assembly 200, the snap 262 of the flap 260 may be fastened to a mating snap 264 of the harness assembly 200 so as to protect the child occupant from the zipper teeth 270.

Figure 11:
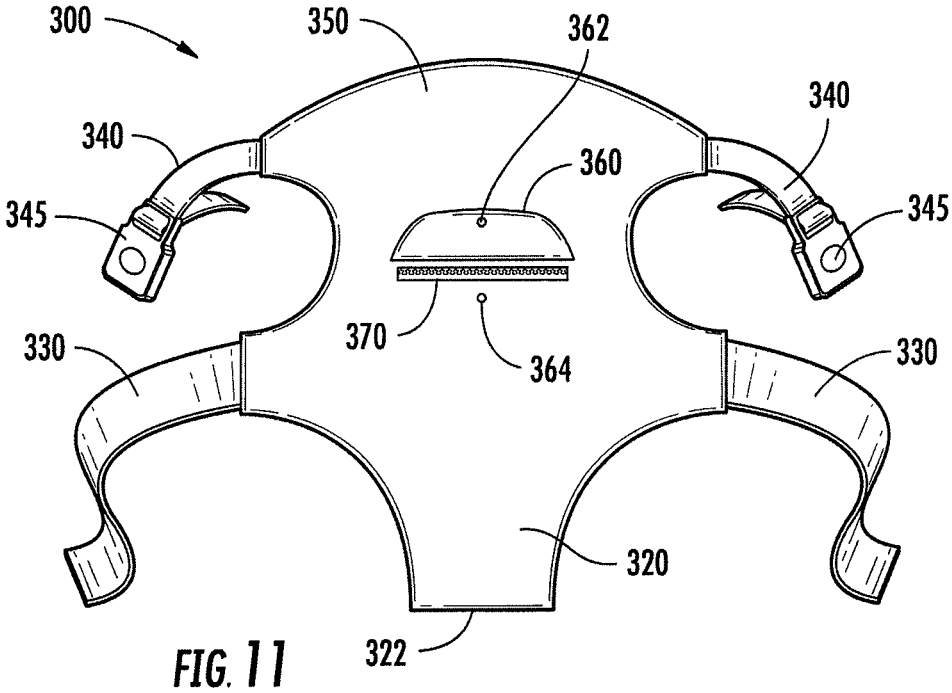
FIG. 11 is another illustration of a pouch assembly according to an example embodiment of the present invention.

FIG. 11 illustrates the pouch assembly 300 of FIG. 4 configured for attachment to the first insert. The zipper 370 of the pouch assembly 300 may engage the second zipper 420 of the second side of the first insert 400. A flap 360 may be arranged to overlay the engaged zipper teeth of the zippers 370, 420 and a snap 362 of the flap 360 may be configured to engage the snap 425 of the first insert 400. When the first insert is not attached to the pouch assembly 300, the snap 362 of the flap 360 may be fastened to a mating snap 364 of the pouch assembly 300 so as to protect the child occupant from the zipper teeth 370.

Figure 12:
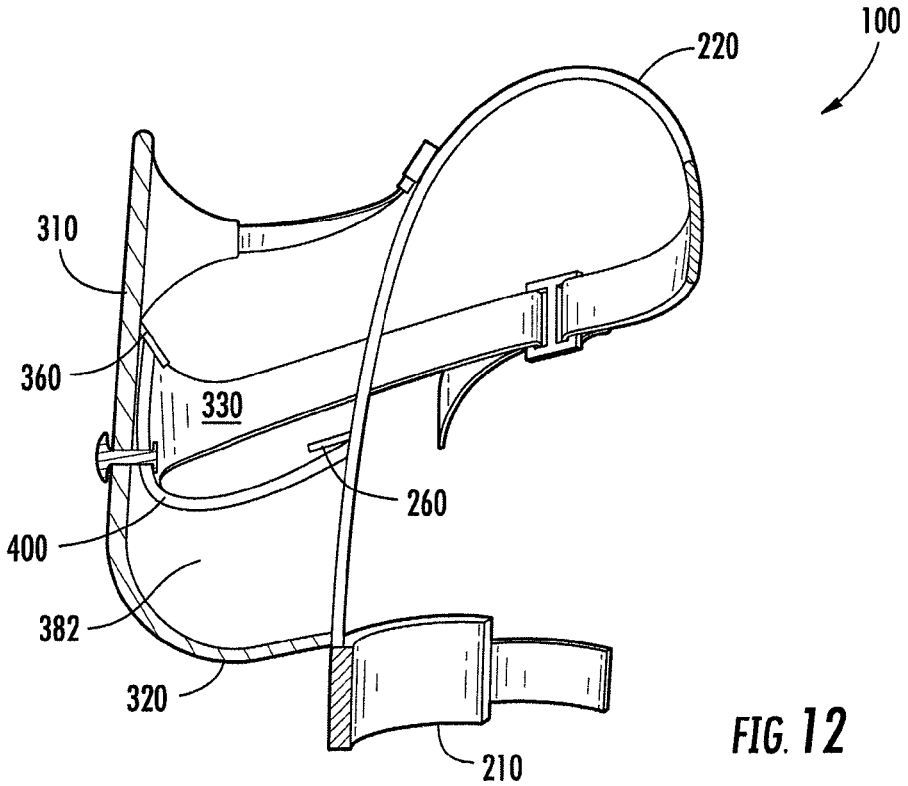
FIG. 12 is a section view of a child carrier including a first insert according to an example embodiment of the present invention.
Figure 13:
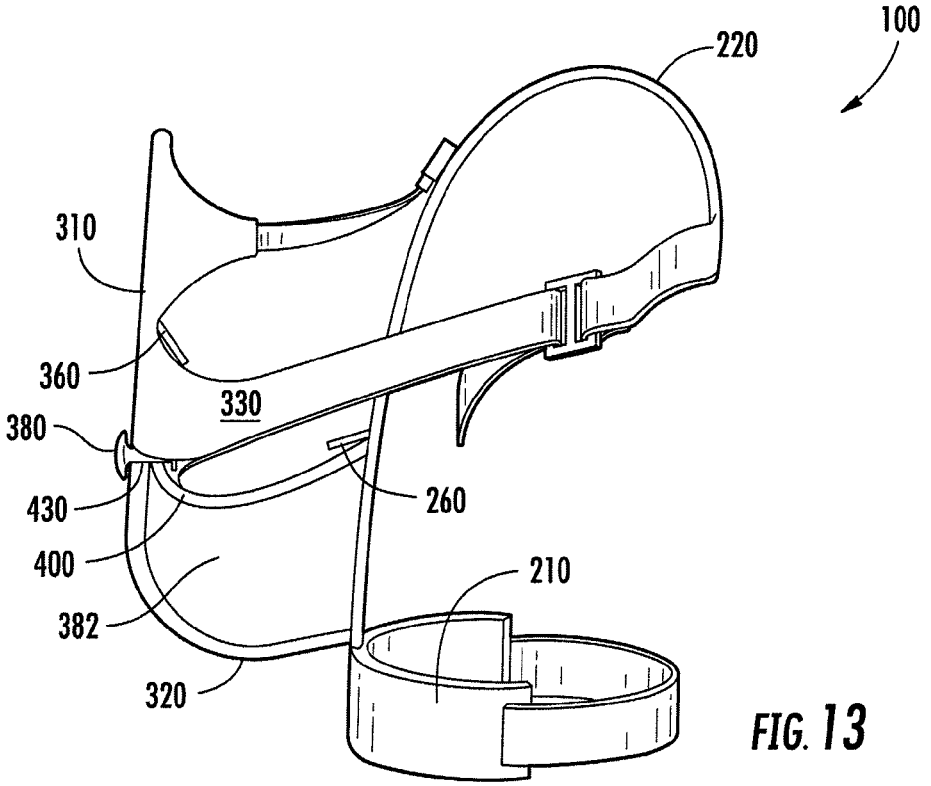
FIG. 13 is an illustration of a side view of the child carrier of FIG. 12.

FIG. 12 illustrates a section view of an example embodiment baby carrier 100 including the first insert 400. As shown, the first insert 400 elevates the area in which the child is seated above the bottom portion 320 of the pouch assembly 300. Elevating the position of a child within the child carrier 100 positions the child's head closer to the wearer's head, which is a preferred position for many wearers. Additionally, the child's head may rest more comfortably on the chest of the wearer (which may include an inclined surface) rather than at the torso of the wearer (which may render the child's position more vertical). Elevating the position of the child may also properly position the child's arms over the mid-harness straps 330 and position the legs below the mid-harness straps 330. Referring back to FIG. 9, the first insert may further include fastener loops 430. As illustrated in FIG. 13 which depicts the embodiment of FIG. 12 without the section view, the fastener loops 430 of the first insert 400 may be attached to fasteners 380 of the pouch assembly 300. The fastener loops 430 may aid in properly positioning the first insert 400 within the pouch for proper alignment and comfort of the child occupant. The fastener loops 430 provide outboard support for the first insert 400 which allows the first insert 400 to achieve maximum width, beyond the width supported by the zippers 410, 370. When the first insert 400 is positioned properly within the child carrier 100 for use with an infant or small child, the leg openings that exist between the padded edges 440 of the first insert 400 and the mid-pouch straps 330 are significantly reduced. The reduced leg openings provide an additional safety factor by limiting the openings proximate the bottom of the child carrier 100 to a size through which a small child may not pass. An additional benefit of using the first insert 400 when carrying a small child or infant may include a two-sided pocket 382 that may be formed between the first insert 400 and the bottom portion 310 of the pouch assembly 300. The pocket 382 may serve as a comfortable hand rest for a wearer and provides access to where the child is seated such that a wearer may more closely hold, comfort, or elevate the child with a hand on the bottom of the first insert 400. The pocket 382 may also be used to hold diapers, napkins, or other accoutrements that may accompany an infant.

Figure 14:
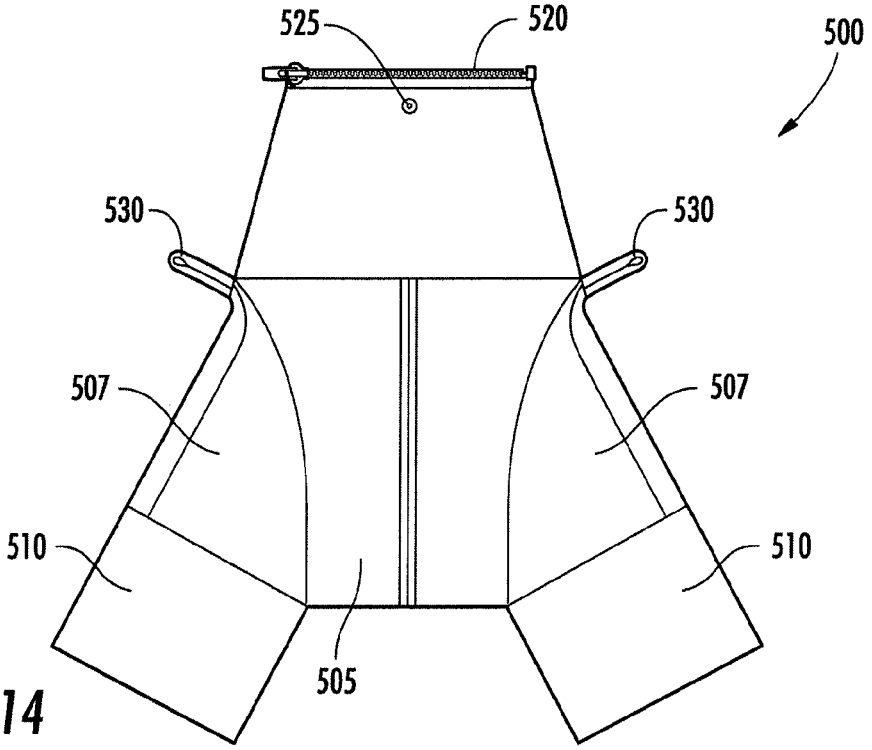
FIG. 14 is an illustration of a second insert according to an example embodiment of the present invention.
Figure 15:
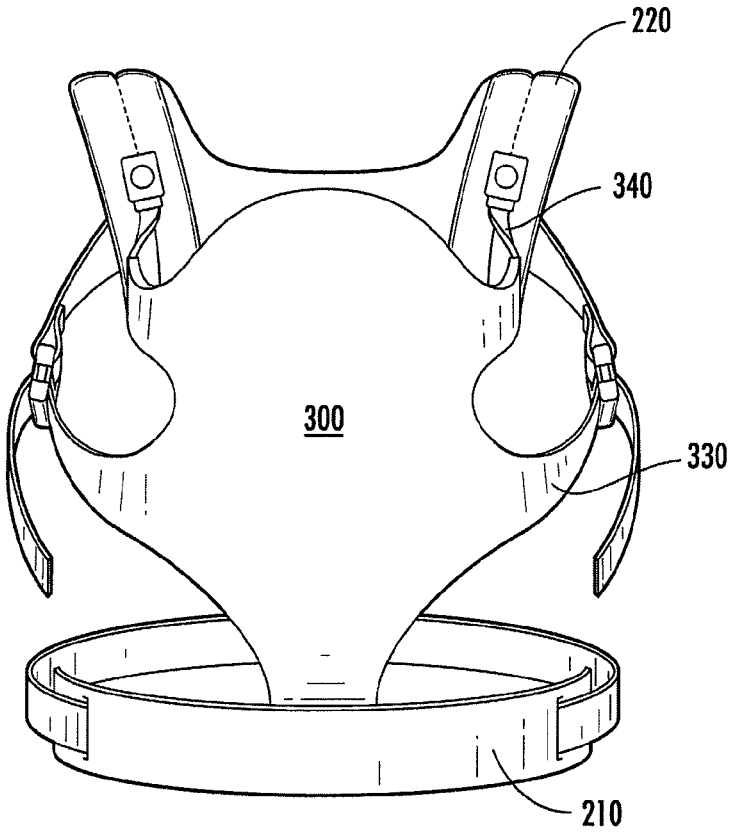
FIG. 15 is an illustration of a frontal view of a child carrier according to example embodiments of the present invention.
Figure 16:
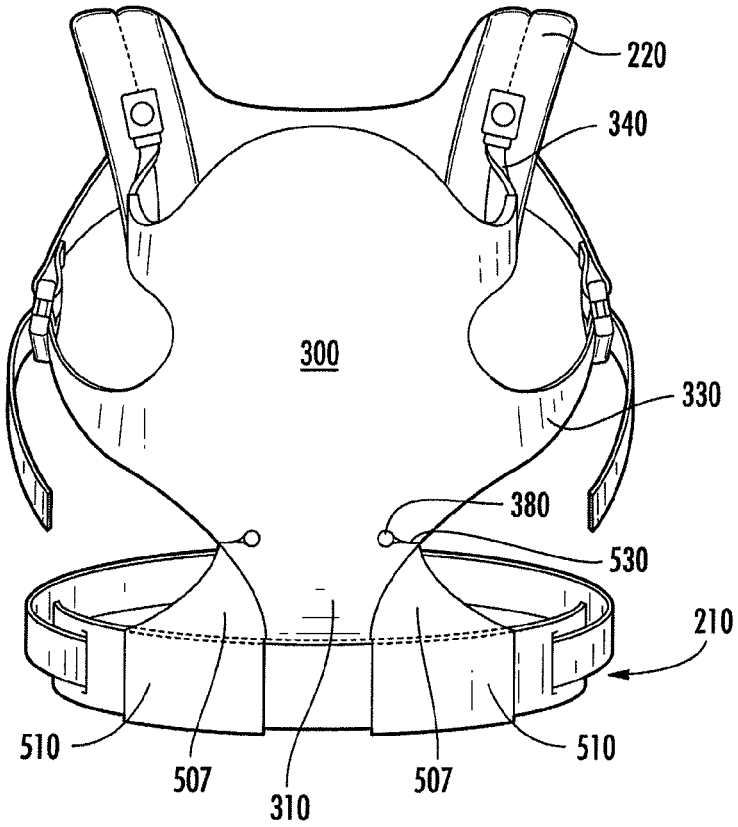
FIG. 16 is an illustration of a frontal view of a child carrier including a second insert according to an example embodiment of the present invention.
Figure 17:
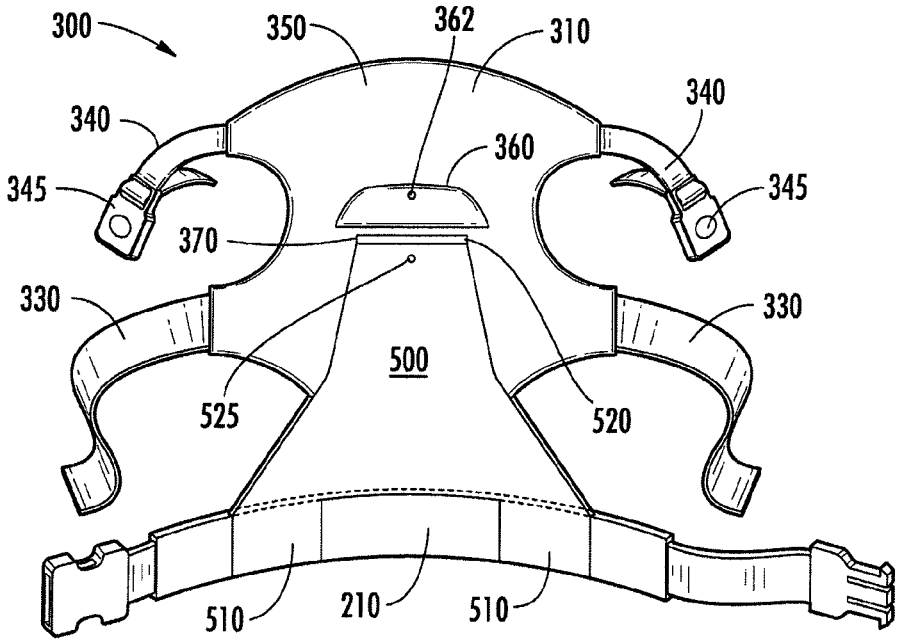
FIG. 17 is an illustration of a pouch assembly including a second insert according to an example embodiment of the present invention.

FIG. 14 illustrates a second insert 500 according to example embodiments of the present invention. The second insert 500 includes belt loops 510, fastener loops 530, a zipper 520, and a snap 525. FIG. 15 illustrates a frontal view of a child carrier according to an example embodiment of the present invention without the second insert 500 installed, while FIG. 16 illustrates the same frontal view of the child carrier with the second insert 500 installed. The belt loops 510 each are configured to fit over a respective end of the waist belt 210 such that the mid portion 505 of the second insert (see FIG. 14) overlays the bottom portion 310 of the pouch assembly 300. The extra width 507 of the second insert 500 extends beyond the bottom portion 310 of the pouch assembly 300 on either side of the bottom portion 310 to form a wider bottom portion. The second insert 500 is at least partially held to the pouch assembly 300 with fastener loops 530 engaged with the fasteners 380 of the pouch assembly. The fastener loops 530, in cooperation with the fasteners 380, hold the second insert 500 against the front portion of the pouch assembly 300 when the second insert 500 is installed. The fastener loops 530, when attached to the fasteners 380, further ensure proper positioning of the second insert 500 and maximize the width of the second insert 500 at the point of the fastener loops 530 when installed. FIG. 17 illustrates the inside of the pouch assembly 300 with the second insert 500 attached to the waist belt 210. The shoulder straps 220, shoulder web 230, and mid-harness straps 230 have been omitted for clarity of illustration. As illustrated, the belt loops 510 fit over the belt 210 to provide a secure seating surface that is significantly wider than the bottom portion of the pouch assembly. The attachment of the second insert 500 to the belt 210 in the illustrated manner ensures that the lower end of the seating area is secured around the waist of a wearer along the entire lower edge of the seating area of the second insert 500 providing additional stability and security for an occupant of the baby carrier. The zipper 520 of the second insert 500 is illustrated as attached to the zipper 370 of the pouch assembly 300. The flap 360 including snap 362 is configured to overlay the zippers 370, 520 and the snap 362 engages the snap 525 of the second insert 500. The second insert 500 provides a wider area on which a child may sit in a rearward-facing position providing the child with a greater surface area to provide support, thereby lessening the pressure supporting the child. The second insert 500 promotes the "froggy-position" carrying style in which the child's knees are at approximately the same height or slightly above their hips, with the knees splayed about the wearer. The second insert 500 further functions to shift the weight of a rearward facing child toward the center of gravity of the wearer which may benefit the comfort of the wearer and the stability and balance of the wearer.

Child carriers according to example embodiments of the present invention may be configured to be used with either of the first insert 400, or the second insert 500, or with no insert at all. Both the first insert 400 and the second insert 500 are configured to be used with a child in a rearward-facing position (i.e., face-to-face with the wearer) while the child carrier without an insert may be used to carry a child in either the rearward-facing position or the forward-facing position. Child carriers according to embodiments of the present invention, with the use of the first insert and the second insert, may be more versatile and comfortably and safely accommodate children from a very small size and young age up to a larger toddler. Further, the configurations available may provide the proper support for children most sizes, but preferably between about 8 pounds and 40 pounds. For example, young infants may benefit from the first insert 400 providing an elevated support holding the child higher on the body of the wearer and positioning the arms and legs properly with respect to the mid-pouch straps 330 and the upper pouch straps 340. Older infants and young toddlers may benefit from the second insert 500 cradling the child to the parent in the well-regarded froggy-position. Further still, toddlers may benefit from the use of the child carrier 100 without inserts and may be positioned comfortably in either the rearward-facing position or the forward-facing position with the top portion 350 of the pouch assembly 300 folded down to provide the child a view of the surroundings.

Child carriers according to example embodiments of the present invention may also include a harness assembly that is both comfortable and secure for a wearer. The shoulder straps 220 may provide padding and support for forces exerted by the child carrier, particularly when using the first insert 400, and the shoulder straps 220 may efficiently transfer weight to the shoulder web 230 worn comfortably across the shoulders at the back of the wearer. The shoulder web 230 may further transfer and balance weight distribution between the shoulder straps 220 (and from the upper pouch straps 340) and the mid-pouch straps 330 (and mid-harness straps 240). Such weight distribution may enhance the comfort of the wearer while promoting proper position on the wearer, which enhances the safety of the child carrier 100. The waist belt 210 may be configured to alleviate weight from the shoulder straps 220 and shoulder web 230, particularly when larger children are carried in the child carrier 100. The waist belt 210 may transfer a significant portion of the weight of the child to the waist and hips of the wearer while reducing the weight applied to the shoulders, thereby lowering the wearer's center of gravity and improving posture, balance, and comfort.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A child carrier configured to carry a child comprising:

a pouch assembly including a bottom portion and a front portion, wherein the bottom portion is configured to substantially support the weight of a child in a first position; a waist belt;

a removable insert, wherein when the removable insert is installed in the child carrier, the removable insert is configured to provide a greater surface area over which the weight of a child in a second, rearward-facing position is distributed, wherein the removable insert is configured to be releasably attached on a first side to the front portion of the pouch and on a second side to the waist belt of the child carrier, wherein the second side of the removable insert comprises first and second belt loops configured to receive the waist belt on either side of the bottom portion of the pouch assembly.

2. The child carrier of claim 1, further comprising a harness assembly attached to the pouch assembly, wherein the harness assembly includes a waist belt and shoulder straps, wherein the shoulder straps extend from a first point on the waist belt to a shoulder web.

3. The child carrier of claim 2, further comprising two mid-harness straps extending from the shoulder web and each at least indirectly and adjustably engaging a respective mid-pouch strap of the pouch assembly.

4. The child carrier of claim 1, wherein the removable insert is releasably attached on the first side to the front portion of the pouch by a zipper.

5. The child carrier of claim 1, further comprising a flap, wherein at least one attachment point of the removable insert to the pouch assembly is configured to be isolated from an occupant of the child carrier by the flap.

6. The child carrier of claim 1, wherein the removable insert is configured to position the child's legs in a splayed position at least partially around the waist of a wearer.

7. A child carrier configured to carry a child comprising:

a pouch assembly including a bottom portion and a front portion, wherein the bottom portion is configured to substantially support the weight of a child in a first position; a waist belt;

a removable insert configured to be removably installed into the pouch assembly, wherein when the removable insert is installed in the child carrier, the removable insert is configured to substantially support the weight of a child in a second, elevated position; and a second removable insert, wherein when the second removable insert is installed in the child carrier, the second removable insert is configured to provide a greater surface area over which the weight of a child in a third, rearward-facing position is distributed, wherein the second removable insert is configured to be releasably attached on a first side to the front portion of the pouch and on a second side to the waist belt of the child carrier, wherein the second side of the second removable insert comprises first and second belt loops configured to receive the waist belt on either side of the bottom portion of the pouch assembly.

8. The child carrier of claim 7, further comprising a harness assembly attached to the pouch assembly, wherein the removable insert is configured to be attached at one end to the pouch assembly and at another end to the harness assembly.

9. The child carrier of claim 8, wherein the harness assembly comprises a waist belt, wherein shoulder straps extend from a first point on the waist belt and wherein the pouch assembly is attached to the waist belt proximate the first point.

10. The child carrier of claim 9, wherein the shoulder straps extend from the first point on the waist belt to a shoulder web.

11. The child carrier of claim 10, further comprising two mid-harness straps extending from the shoulder web and each at least indirectly and adjustably engaging a respective mid-pouch strap of the pouch assembly.

12. The child carrier of claim 7, wherein the first removable insert is configured to be attached to the pouch assembly with a zipper.

13. The child carrier of claim 7, further comprising a flap, wherein at least one attachment point of the removable insert to the pouch assembly is configured to be isolated by the flap from a child when the child is positioned in the child carrier.

14. The child carrier of claim 7, wherein the second removable insert is configured to position the child's legs in a splayed position at least partially around the waist of a wearer.

15. The child carrier of claim 7, wherein the bottom portion and the second removable insert cooperate to support the weight of a child in the third position.

16. The child carrier of claim 7, wherein the first position, second position, and third position of a child in the child carrier are each different.

17. A child carrier comprising:

a harness assembly comprising a first and second shoulder strap extending from a waist belt, wherein the first and second shoulder straps are configured to extend over a left and right shoulder of a wearer, respectively;

a pouch assembly comprising a front portion and a bottom portion, wherein a pouch is defined on a first side by the front portion, on a second side by the first and second shoulder straps, and on a bottom by the bottom portion;

a removable insert configured to be releasably attached to the pouch on a first side to the front portion and on a second side to the first and second shoulder straps, wherein the removable insert is elevated relative to the bottom of the pouch when attached to the pouch and the shoulders straps; and a second removable insert, wherein the second removable insert is configured to be releasably attached on a first side to the front portion of the pouch and on a second side to the waist belt wherein the second side of the second removable insert comprises first and second belt loops configured to receive the waist belt on either side of the bottom portion of the pouch assembly.

18. The child carrier of claim 17, wherein the removable insert is releasably attached to the front portion by a zipper attachment and wherein the removable insert is releasably attached to the first and second shoulder straps by a zipper attachment.

19. The child carrier of claim 18, further comprising a first flap attached to the front portion configured to cover the zipper attachment of the front portion and a second flap attached to the first and second shoulder straps configured to cover the zipper attachment of the first and second shoulder straps.

20. The child carrier of claim 18, further comprising a shoulder web, wherein the first and second shoulder straps extend from the waist belt, over the left and right shoulders of the wearer respectively, and terminate at the shoulder web.

* * * * *